US009415980B2

(12) United States Patent
Geiser et al.

(10) Patent No.: US 9,415,980 B2
(45) Date of Patent: Aug. 16, 2016

(54) LIFT CRANE WITH MAST-RAISING MECHANISM

(71) Applicant: Manitowoc Crane Companies, LLC, Manitowoc, WI (US)

(72) Inventors: Darin J. Geiser, Appleton, WI (US); Robert J. Walker, Manitowoc, WI (US)

(73) Assignee: Manitowoc Crane Companies, LLC, Manitowoc, WI (US)

( * ) Notice: Subject to any disclaimer, the term of this patent is extended or adjusted under 35 U.S.C. 154(b) by 0 days.

(21) Appl. No.: 14/605,806

(22) Filed: Jan. 26, 2015

(65) Prior Publication Data

US 2015/0210516 A1 Jul. 30, 2015

Related U.S. Application Data

(60) Provisional application No. 61/932,060, filed on Jan. 27, 2014, provisional application No. 61/937,421, filed on Feb. 7, 2014.

(51) Int. Cl.
*B66C 23/82* (2006.01)

(52) U.S. Cl.
CPC ..... *B66C 23/82* (2013.01)

(58) Field of Classification Search
CPC ..... B66C 23/62; B66C 23/64; B66C 23/68; B66C 23/82; B66C 23/26; B66C 23/42; B66C 23/36; B66C 23/365
USPC ..... 212/175, 179, 180, 294, 298, 299
See application file for complete search history.

(56) References Cited

U.S. PATENT DOCUMENTS

| | | | | |
|---|---|---|---|---|
| 4,134,500 | A * | 1/1979 | Sauber | B66C 23/54 212/261 |
| 6,062,405 | A | 5/2000 | Pech et al. | |
| 6,695,158 | B2 | 2/2004 | Taylor et al. | |
| 2006/0102577 | A1 | 5/2006 | Vestenik | |
| 2008/0264887 | A1 | 10/2008 | Porubcansky | |
| 2012/0152878 | A1 * | 6/2012 | Ishihara | B66C 23/365 212/280 |

OTHER PUBLICATIONS

International Search Report and Written Opinion for International Application No. PCT/US2015/012936, dated May 7, 2015 (10 pages).

* cited by examiner

*Primary Examiner* — Sang Kim
*Assistant Examiner* — Juan Campos, Jr.
(74) *Attorney, Agent, or Firm* — Craig Buschmann; Brinks Gilson & Lione

(57) ABSTRACT

A mast-raising mechanism for raising a mast of a mobile lift crane to an operating position includes a hydraulic cylinder extendable to raise the mast. The hydraulic cylinder includes a first end pivotally coupled to a rotating bed of the crane and a second end spaced apart from the first end. A first arm includes a first end pivotably coupled to the second end of the hydraulic cylinder. The hydraulic cylinder extends to press the first end against a bearing surface on the mast. The first arm also includes a second end spaced apart from the first end. A second arm includes a first end proximate the second end of the first arm and a second end spaced apart from the first end. The second end of the second arm is pivotably connected to the rotating bed. A biasing mechanism urges the first arm towards the second arm.

21 Claims, 7 Drawing Sheets

LIFT CRANE WITH MAST-RAISING MECHANISM

PRIORITY CLAIM

The present application claims priority to and the benefit of U.S. Provisional Patent Application Ser. No. 61/932,060 filed Jan. 27, 2014 and titled Lift Crane With Mast-Raising Mechanism and U.S. Provisional Patent Application Ser. No. 61/937,421 filed Feb. 7, 2014 and titled Lift Crane With Mast-Raising Mechanism, the disclosures of which are incorporated in their entirety by this reference.

BACKGROUND

The present application relates to construction equipment, such as cranes. In particular, the present application relates to a crane having arms for raising a mast, i.e., a self-raising mast. The present application also relates to a method of self-raising the mast and assembling the crane.

Construction equipment, such as cranes or excavators, must often be moved from one job site to another. Moving a crane or an excavator can be a formidable task when the machine is large and heavy. For example, highway limits on vehicle-axle loads must be observed, and overhead obstacles can dictate long, inconvenient routings to the job site.

One solution to improving the mobility of large construction machines, such as cranes, is to disassemble them into smaller, more easily handled components. The separate components can then be transported to the new job site where they are reassembled.

The typical practice has been to use an assist crane to disassemble the crane into the separate components. The assist crane is then used to load the components onto their respective transport trailers. Once at the new job site, another assist crane is used to unload the components and reassemble the crane.

As the components for a large crane can weigh in excess of 80,000 lbs., the capacity of the assist crane required represents a very significant transport expense. As a result, designers have attempted to develop self-handling systems for assembling and disassembling cranes. The majority of the self-handling systems developed thus far have been directed to smaller cranes that only need to be disassembled into a few components.

The development of self-handling systems for larger cranes, however, has met with limited success. One reason for this is that larger cranes need to be disassembled into numerous components, thus requiring time-consuming disassembly and reassembly procedures. For example, a large capacity crane typically uses a complicated and cumbersome rigging system to control the angle of the boom. Boom rigging system components such as the equalizer, the mast, and wire rope rigging are heavy and difficult to disassemble for transport.

Another reason for the limited success of prior art self-assembling cranes is that they typically rely on additional crane components that are used only for assembling and disassembling the crane. For example, some self-assembling cranes require additional wire rope guides and sheaves on the boom butt so that a load hoist line can be used with the boom butt to lift various crane components during the assembly process.

An example of a prior art method for assembling and disassembling a typical large capacity crawler crane is disclosed in U.S. Pat. No. 5,484,069, titled "Process For Self-Disassembling A Crawler Crane" ("the '069 patent"). In particular, this patent is directed to a type of crawler crane having a mast that is supported by a backhitch.

Another example of a prior art method for assembling and is assembling a different type of crawler crane is disclosed in U.S. Pat. No. 6,062,405, titled "Hydraulic Boom Hoist Cylinder Crane" ("the'405 patent"). This patent is directed to a type of crane that utilizes hydraulic cylinders to control the angle of the boom.

The '069 patent and the'405 patent are both examples of self-assembling cranes that require the use of the boom butt to lift and position components for assembly on to the crane. As a consequence, additional sheaves must be included on the boom butt for the self-assembling procedure. It is therefore desirable to provide a crane and method of self-assembly which eliminates, or at least reduces, the use of the boom butt during the self-assembling procedure.

In addition to the above, some types of cranes utilize a moving or live mast. A crane having a moving or live mast is connected directly to the boom by one or more boom pendants. The boom angle is controlled by boom hoist rigging, which is connected between the mast and the upper works of the crane. The mast and the boom move together as the boom angle is changed. The mast must typically be disconnected from the boom and stored horizontally on top of the crane for transport between job sites. Moreover, the masts on these types of cranes are often very long and heavy, and are consequently difficult to handle during the assembly process. It is therefore desirable to provide a crane having a self-raising mast. It is also desirable to provide a system and method of controlling the mast self-raising procedure that is safe, efficient and easy to implement.

Another of the challenges to having a self-raising mast is the limited space on a crane's upper works or rotating bed in which to install the raising mechanism. For example, it is desirable to install a linear actuator, such as a hydraulic cylinder with an extension rod, that provides as nearly perpendicular force to the mast throughout its course of travel as possible. Of course, since the mast typically rotates about a fixed point on the rotating bed, the force of the cylinder rarely is perpendicular. That said, when the mast is positioned in a near horizontal position it is most efficient for the hydraulic cylinder to be positioned near vertically so that the extension rod presses most closely to a perpendicular position relative to the mast. The problem, however, with such an arrangement is that the hydraulic cylinder extends through a portion or all of the rotating bed. There simply may not be sufficient space to position the hydraulic cylinder vertically, then.

Alternatively, the linear actuator, such as a hydraulic cylinder or other raising mechanism, could be positioned at an angle to the mast rather than nearly vertically. Thus, the closer to parallel the linear actuator lies to the mast, the less vertical space within the rotating bed that the linear actuator occupies. The drawback to this solution, however, is that the closer to parallel that the actuator lies relative to the mast, the force normal to the mast that the actuator applies decreases. In other words, it is relatively more difficult for an actuator, such as a hydraulic cylinder, of a given size to raise a mast when it is positioned more closely to parallel with the mast.

To overcome this, and to apply a greater force normal to the mast, one can increase the size and/or capacity of the cylinder. This would result in more force being applied normal to the mast, but much of the additional capacity of the larger hydraulic cylinder is wasted because it is applied in a direction parallel to the mast. Further, the benefits of packaging the cylinder at an angle to the mast in terms of providing greater available space in the rotating bed are defeated, in part, by increasing the size/capacity of the hydraulic cylinder. In other words, solving the problem of space in the vertical direction of the rotating bed may simply create a problem of insufficient space in an angled and/or horizontal direction of the rotating bed.

In U.S. Pat. No. 6,695,158, titled "Crane With Self-Raising Mast" (the "'158 patent"), a crane has an upper works rotatably mounted on a lower works, a boom pivotally mounted on the upper works, a mast pivotally mounted on the upper works and pendantly connected to the boom, and boom hoist rigging connected to the mast for controlling the angle of the boom. The invention further comprises a self-raising mast assembly for controlling the position of the mast when the mast is not connected to the boom. The self-raising mast assembly comprises a mast raising yoke, a hydraulic mast raise cylinder, and a hydraulic system.

The '158 solves some of the issues discussed with the prior art, but it involves several components that rotate and are pinned together, increasing the complexity of the mechanism. Further, it involves positing the hydraulic cylinder in relatively vertical position within the rotating bed of the crane, which consumes a significant amount of vertical space in the rotating bed.

It is therefore desirable to provide a crane and method of self-assembly which is mechanically simple relative to the prior art and reduces the amount of space into which it is packaged or positioned within the rotating bed.

BRIEF SUMMARY

A mobile lift crane has an upper works or rotating bed rotatably mounted on a lower works or carbody, a boom pivotally mounted on the upper works, a mast pivotally mounted on the upper works and connected to the boom, and boom hoist rigging connected to the mast for controlling the angle of the boom. The invention further comprises a self-raising mast assembly for controlling the position of the mast when the mast is not connected to the boom.

An embodiment of a mast-raising mechanism for raising a mast of a mobile lift crane from a stowed position for travel to an operating position includes a bearing surface coupled to a lower surface of the mast. A linear actuator is extendable to raise the mast. In some embodiments, the linear actuator is a hydraulic cylinder, although other linear actuators such as a drive screw and nut, rack and pinion, winches and pulleys, and other types of linear actuators are contemplated. In the embodiment of a hydraulic cylinder, the cylinder includes a first end pivotally coupled to a rotating bed of the crane and a second end spaced apart from the first end. A first arm includes a first end pivotably coupled to the second end of the hydraulic cylinder. The first end includes a plate oriented to press against the bearing surface to raise the mast when the hydraulic cylinder is extended, and a second end spaced apart from the first end. A second arm includes a first end proximate the second end of the first arm, and a second end spaced apart from the first end. The second end of the second arm is pivotably connected to the rotating bed. A biasing mechanism couples the second end of the first arm to the first end of the second arm and urges the first arm towards the second arm. In some embodiments, the second end of the first arm abuts the first end of the second arm when the mast is stowed, but the second end of the first arm does not abut the first end of the second arm when the hydraulic cylinder extends and presses the first end of the first arm against the bearing surface Another embodiment of a mast-raising mechanism for raising a mast of a mobile lift crane from a stowed position for travel to an operating position includes a bearing surface coupled to a lower surface of the mast. A hydraulic cylinder is extendable to raise the mast. The hydraulic cylinder includes a first end pivotally coupled to a rotating bed of the crane and a second end spaced apart from the first end. A first arm includes a first end pivotably coupled to the second end of the hydraulic cylinder. The first end includes a plate oriented to press against the bearing surface to raise the mast when the hydraulic cylinder is extended and closes a gap that exists between the bearing surface and the plate of the first arm when the mast is stowed. The first arm also includes a second end spaced apart from the first end. A second arm includes a first end proximate the second end of the first arm, and a second end spaced apart from the first end. The second end of the second arm is pivotably connected to the rotating bed. A biasing mechanism couples the second end of the first arm to the first end of the second arm and urges the first arm towards the second arm.

In yet another embodiment, a mast-raising mechanism for raising a mast of a mobile lift crane from a stowed position for travel to an operating position includes a bearing surface coupled to a lower surface of the mast. A hydraulic cylinder is extendable to raise the mast. The hydraulic cylinder includes a first end pivotally coupled to a rotating bed of the crane and a second end spaced apart from the first end.

A first arm includes a first end pivotably coupled to the second end of the hydraulic cylinder. The first end includes a plate oriented to press against the bearing surface to raise the mast when the hydraulic cylinder is extended and closes a gap that exists between the bearing surface and the plate of the first arm when the mast is stowed. The first arm also includes a second end spaced apart from the first end. The first arm includes an end plate proximate the second end of the first arm, the end plate having a first side, a second side spaced apart from the first side, and at least one hole extending through the first side and the second side.

A second arm includes a first end proximate the second end of the first arm, and a second end spaced apart from the first end. The second end of the second arm is pivotably connected to the rotating bed. The second arm also includes an outer plate proximate the first end of the second arm. The outer plate has a first side, a second side spaced apart from the first side, and at least one hole extending through the first side and the second side.

A biasing mechanism couples the second end of the first arm to the first end of the second arm and urges the first arm towards the second arm. The biasing mechanism includes a rod extending through each of the holes of the end plate and the outer plate. The rod is coupled to at least the end plate. In some embodiments, the biasing mechanism includes a spring disposed at least partly around the rod.

Yet another embodiment comprises a mobile lift crane that incorporates any of the embodiments of the mast-raising mechanism. The lift crane itself includes movable ground engaging members mounted on a carbody that allow the crane to move over the ground, a rotating bed rotatably mounted on the carbody, a boom pivotally mounted on the rotating bed, and a mast pivotally connected to the rotating bed.

Various embodiments of the invention also include methods of raising and lowering a mast-raising mechanism in order to raise a mast on a crane.

For example, an embodiment of a method of using any of the disclosed embodiments of the mast-raising mechanism include extending the hydraulic cylinder to open a gap between the second end of the first arm and the first end of the second arm, urging the first end of the first arm against the bearing surface to raise the mast to an operating position, retracting the hydraulic cylinder at least partly under the influence of the biasing mechanism urging the first arm towards the second arm, and closing the gap between the second end of the first arm and the first end of the second arm. Embodiments of the method include stowing the hydraulic cylinder, the first arm, and the second arm in the rotating bed.

The mast-raising mechanism and method permits the mast to be raised and lowered during the assembly process without the need for a separate crane, and overcomes many of the problems identified above. In particular, the self-raising mast assembly and method permits the mast to be raised from and lowered to a stored position on the rearward portion of the upper works.

These and other advantages, as well as the invention itself, will become more easily understood in view of the attached drawings and apparent in the details of construction and operation as more fully described and claimed below. Moreover, it should be appreciated that several aspects of the invention can be used with other types of cranes, machines or equipment.

DETAILED DESCRIPTION

Figure 1:
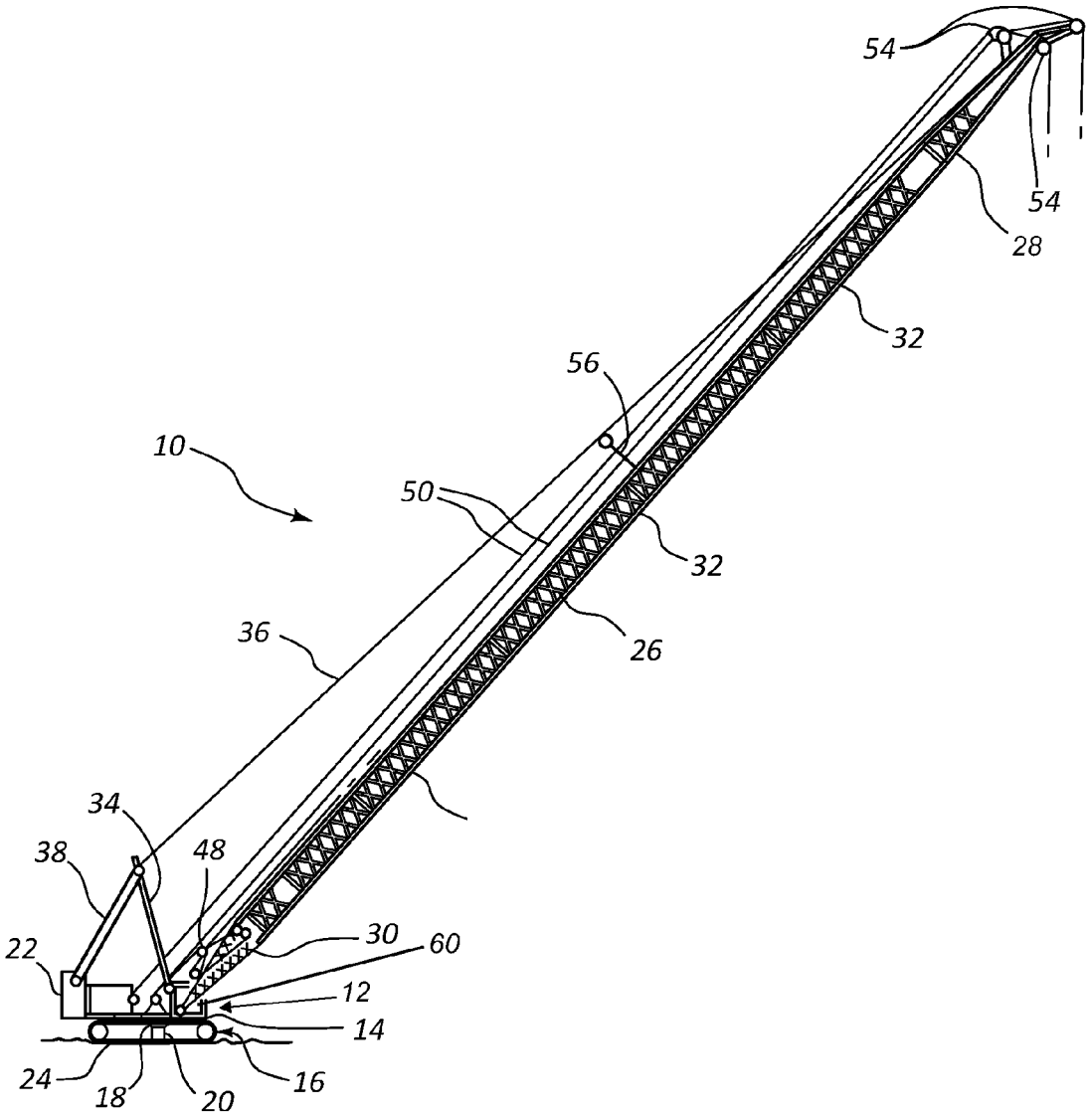
FIG. 1 is a right side elevation view of a mobile lift crane that includes an embodiment of a mast-raising mechanism.

The present invention will now be further described. In the following passages, different aspects of the embodiments of the invention are defined in more detail. Each aspect so defined may be combined with any other aspect or aspects unless clearly indicated to the contrary. In particular, any feature indicated as being preferred or advantageous may be combined with any other feature or features indicated as being preferred or advantageous.

Several terms used in the specification and claims have a meaning defined as follows.

The term "rotating bed" refers to the upperworks of the crane (the part that rotates with respect to the carbody), but does not include the boom or any lattice mast structure. The rotating bed may be made up of multiple parts. For example, for purposes of the present invention, the adapter plate disclosed in U.S. Pat. No. 5,176,267 would be considered to be part of the rotating bed of the crane on which it is used. Also, if a crane is taken apart for transportation between job sites, the rotating bed, as that term is used herein, may be transported in more than one piece. Further, when a component, such as a counterweight support frame is attached to the remainder of the rotating bed in a manner that it stays fixed to the remainder of the rotating bed until completely removed, it can be considered to be part of the rotating bed.

The term "mast" refers to a structure that is attached to the rotating bed and is part of the boom hoist system. The mast is used to create an elevated point above the other parts of the rotating bed through which a line of action is established so that the boom hoist system is not trying to pull the boom up along a line nearly through the boom hinge pin during a set-up operation. In this regard, a gantry or some other elevated structure on the rotating bed can serve as a mast. The mast may be a fixed mast, a derrick mast or a live mast, depending on the embodiment of the invention. A live mast is one that has fixed length pendants between the mast and the boom during normal crane pick, move and set operations, and the angle of the boom is changed by changing the angle of the mast. A fixed mast is designed to stay at a fixed angle with respect to the rotating bed during normal crane pick, move and set operations. (However, a small degree of movement may occur in a fixed mast if the balance of the counterweight moment and the combined boom and load moment change so that the mast is pulled backward by the counterweight. In that case mast stops are used to hold the mast up, but those mast stops may allow for a small degree of movement.) Of course a mast which is fixed during normal crane operations may be pivotal during crane set-up operations. A derrick mast is one that has adjustable length boom hoist rigging between the mast and the boom, thus allowing the angle of the boom with respect to the plane of rotation of the rotating bed to be changed, but also is connected to the rotating bed in a pivotal fashion, and is connected to the rear of the rotating bed with an adjustable-length connection. A derrick mast may be used as a fixed mast by keeping the angle of the derrick mast with respect to the rotating bed constant during a pick, move and set operation.

In some instances, a mast is stowed within or upon the rotating body while the crane is transported between job sites. The mast is stowed substantially horizontally either facing towards the front portion or, more typically, the rear portion of the rotating bed to reduce the height of the components of the crane to ensure that the components meet any over-the-road travel restrictions for height. By substantially horizontal, it is meant that the mast can be stored with its long axis parallel to the ground, as well as in those circumstances in which the long axis of the mast slopes several degrees above or below parallel. For example, for purposes of this application, the long axis of the mast may slope ±20 degrees above or below true horizontal and still fall within the scope of the term "substantially horizontal."

The front of the rotating bed is defined as the portion of the rotating bed that is between the axis of rotation of the rotating bed and the position of the load when a load is being lifted. The rear of the rotating bed includes everything opposite the axis of rotation from the front of the rotating bed. The terms "front" and "rear" (or modifications thereof such as "rearward") referring to other parts of the rotating bed, or things connected thereto, such as the mast, are taken from this same context, regardless of the actual position of the rotating bed with respect to the ground engaging members.

The moveable ground engaging members are defined as members that are designed to remain engaged with the ground while the crane moves over the ground, such as tires or crawlers, but does not include ground engaging members that are designed to be stationary with respect to the ground, or be lifted from contact with the ground when they are moved, such as a ring on a ring supported crane and outriggers commonly found on truck mounted cranes.

Embodiments of the present invention find application in all types of cranes or construction machines, including those with both a fixed mast and a live mast. That said, the following description describes a mast-raising mechanism with respect to the crawler crane 10 of FIG. 1.

The crawler crane 10 includes an upper works 12 having a rotating bed 14 that is rotatably connected to a lower works 16 by a swing bearing 18. The lower works 16 includes a car body 20, counterweights 22, and ground engaging members 24. Illustrated in FIG. 1 are crawlers, although term ground engaging members encompasses things such as tires, for example. In addition, while only one ground engaging member 24 is visible, an identical ground engaging member 24 exists on the other side of crane 10. Further, the disclosure is not limited to only two ground engaging members 24. Rather, crane 10 may employ a plurality of ground engaging members, such as 3, 4, or more.

The rotating bed 14 includes a boom 26 pivotally connected to the rotating bed 14. The boom 26 comprises a boom top 28 and a tapered boom butt 30. The boom 26 may also include one or more boom inserts 32 connected between the boom top 28 and the boom butt 30 to increase the overall length of the boom 26. While FIG. 1 illustrates a lattice style boom 26, other known types of booms, such as round, oval, and/or telescoping type booms fall within the scope of the disclosure. A mast 34 is pivotally connected to the rotating bed 14. The boom 26 is connected to the mast 34 by one or more boom pendants 36.

The angle of the boom 26 is controlled by boom hoist rigging 38 connected between the upper works 12 and the mast 34. While not illustrated, the-boom hoist rigging 38 comprises a boom hoist rope that passes (reeved) around a sheave assembly on the upper end of the mast and a sheave assembly on the rear end of the rotating bed 14. One end of the boom hoist rope is typically anchored to the rotating bed 14, while the other end is anchored to and wrapped around the boom hoist drum.

The mast 34 supports the connection between the boom hoist rigging 38 and the boom pendants 36 at a location that is distanced from the axis of the boom 26 to optimize the forces in the boom pendants 36 and the boom hoist rigging 38. This arrangement also permits the boom hoist rigging 38 to impart a force having a component that is perpendicular to the axis of the boom 26. This force is transferred to the end of the boom 26 by the boom pendants 36. Because the weight of the boom 26 is significantly greater than the weight of the mast 34 and the boom hoist rigging 38, the boom hoist rope and the boom pendants 36 are always in tension as long as the boom 26 is within the normal operating range of the crane 10. Conversely, the mast 34 is always in compression as long as the boom 26 is within the normal operating range of the crane 10. A boom backstop 48 is provided to prevent the boom 26 from exceeding a safe operating position.

Rotation of the boom hoist drum in one direction (e.g., clockwise) will retract the boom hoist rope, thereby shortening the length of the boom hoist rigging 38 and causing the upper end of the mast 34 to be pulled towards the rear of the rotating body. This in turn raises the end of the boom 26 (i.e., increases the boom angle). Likewise, rotation of the boom hoist drum in the opposite direction (e.g., counter-clockwise) will payout the boom hoist rope, thereby increasing the length of the boom hoist rigging 38 and allowing the upper end of the mast 34 to be pulled away from rear of the rotating bed 14 by the weight of the boom 26. This action results in the lowering of the end of the boom 26 (i.e., decreases the boom angle).

The upper works 12 further includes one or more load hoist lines 50 for lifting loads. Each load hoist line 50 is passed (reeved) around a load hoist line drum (not illustrated) supported on the rotating bed 14 of the upper works 12. The load hoist line drums are rotated to either pay out or retrieve the load hoist lines 50. The load hoist lines 50 are reeved around one or a plurality of boom top sheaves 54 located at the upper end of the boom top 28. The boom may also include one or more wire rope guides 56 attached to upper surface of the boom 26 to prevent the load hoist lines 50 from interfering with the lattice structure of the boom 26. A hook block (not shown) is typically attached to each load hoist line 50.

The rotating body 14 or the upper works 12 further includes a power plant, such as a diesel engine (not illustrated), and a counterweight assembly 22. The power plant supplies power for the various mechanical and hydraulic operations of the crane 10, including movement of the ground engaging members 24, rotation of the rotating bed 14, rotation of the load hoist line drums, and rotation of the boom hoist drum. Operation of the various functions of the crane 10 is controlled from the operator's cab 60.

Figure 2:
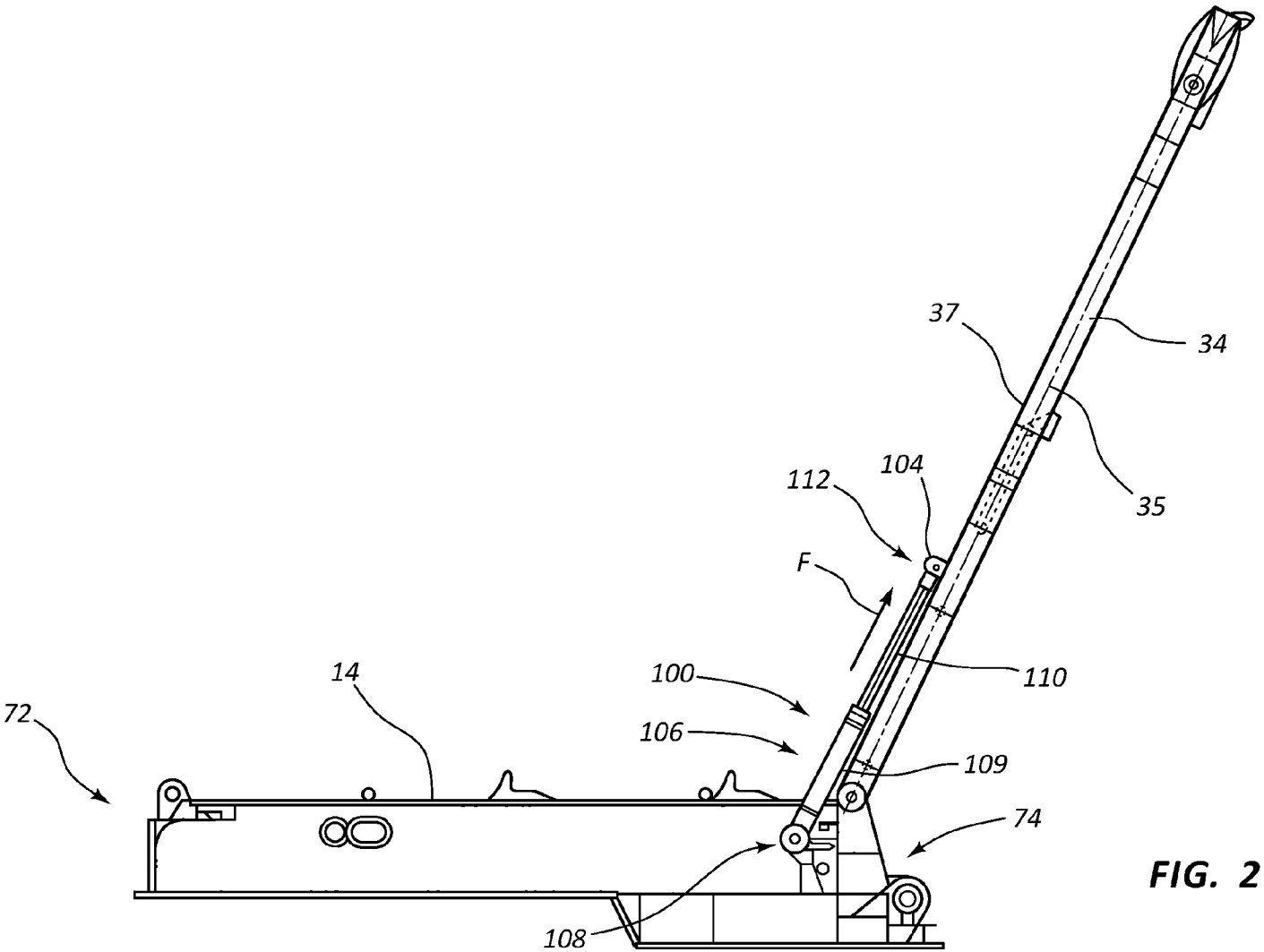
FIG. 2 is a right side elevation view of the rotating bed of the crane of FIG. 1 with the mast in a stable upright position and with several elements removed for clarity.

Referring to FIG. 2, the mast 34 in this embodiment comprises a frame having two spaced apart rectangular legs or arms that are not visible in the plan view. Further, masts of different shapes, including round and oval tubular shapes fall are encompassed in this disclosure. The mast 34 should not interfere with the operation of the load hoist lines 50 or the boom backstop 48. In addition, the mast 34 should be configured so as to permit the mast 34 to be lowered to an approximately or substantially horizontal stored position on top of the rotating body 12 or, depending on the configuration of the rotating body 12, within a recess 70 (FIG. 3) in the rotating body 14. This permits the overall height of the disassembled crane 10 to be minimized so that highway height restrictions will not be violated during transport to and from the job site. As will be explained below, the mast 34 is ordinarily not disassembled from the crane 10 during transport. The mast 34 should also be configured so as to permit the mast 34 to be lowered to an approximately horizontal fully rearward position towards the rear portion 72 of the rotating bed 14. Nonetheless, the mast 34 can also be configured to be rotated, lowered, and stowed in a forward direction towards the front portion 74 of the rotating bed 14.

FIG. 2 illustrates the rotating bed 14 with all but the mast 34 and the mast-raising mechanism 100 removed for clarity. The mast 34 is illustrated in a stable upright position after the mast-raising mechanism 100 has raised it from its stowed position. At this point, the mast-raising mechanism 100 could be retracted and stowed.

The mast-raising mechanism 100 includes a bearing surface 104 that is coupled to a lower surface 37 of the mast 34. It is important to consider that the lower surface 37 is referred to as such in deference to its position on the lower side of the mast 34 when the mast 34 is rotated rearward and is substantially horizontal in its stowed position. The bearing surface 104 can be attached to the lower surface 37 through welding, other known methods, or it can simply be an integral component of the lower surface 37. The bearing surface 104 is substantially vertically oriented and perpendicular to a long-axis 35 of the mast 34 when the mast 34 is in its stowed position. The bearing surface 104 is oriented in this manner, in part, to provide a surface that is oriented more closely to normal or perpendicular to the force F that the mast-raising mechanism 100 applies to the bearing surface 104 to raise the mast 34. This configuration is an improvement over the prior art in which a mast-raising mechanism might apply a force to the lower surface of the mast, which is oriented more closely to parallel to the force, which resulted in a relatively small normal component of the force to actually raise the mast.

The mast-raising mechanism 100 also includes a linear actuator 106 that is extendable to raise the mast 34. In some embodiments, the linear actuator 106 is a hydraulic cylinder, as illustrated in the figures, although other linear actuators such as a drive screw and nut, rack and pinion, winches and pulleys, and other types of linear actuators are contemplated. Thus, while the concept of a linear actuator encompasses all of these and equivalent features, for convenience reference typically will be made to a hydraulic cylinder.

Figure 3:
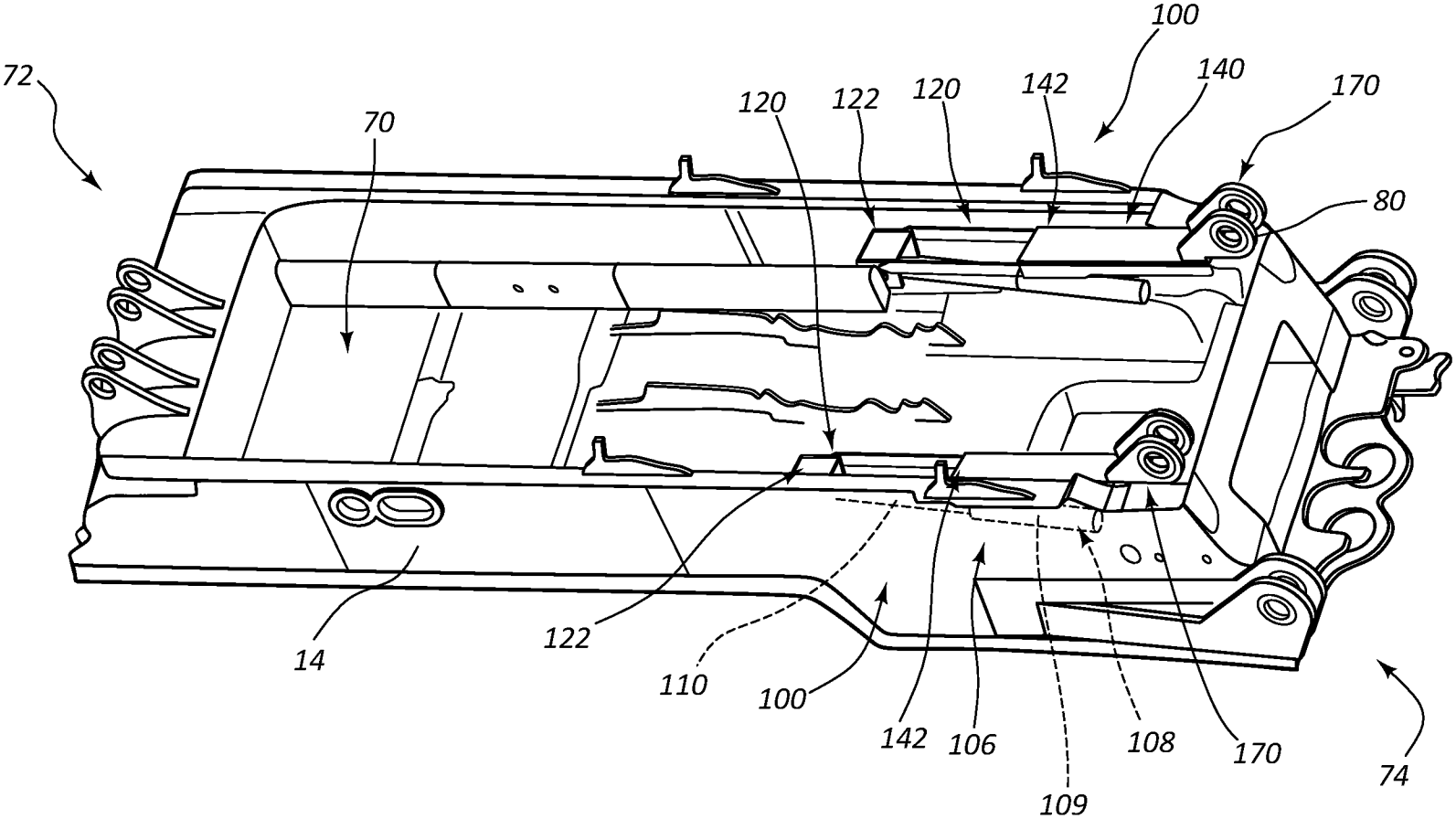
FIG. 3 is a top perspective view of the rotating bed and the biasing mechanism of the crane of FIG. 1 with the mast and several other elements removed for clarity.
Figure 4:
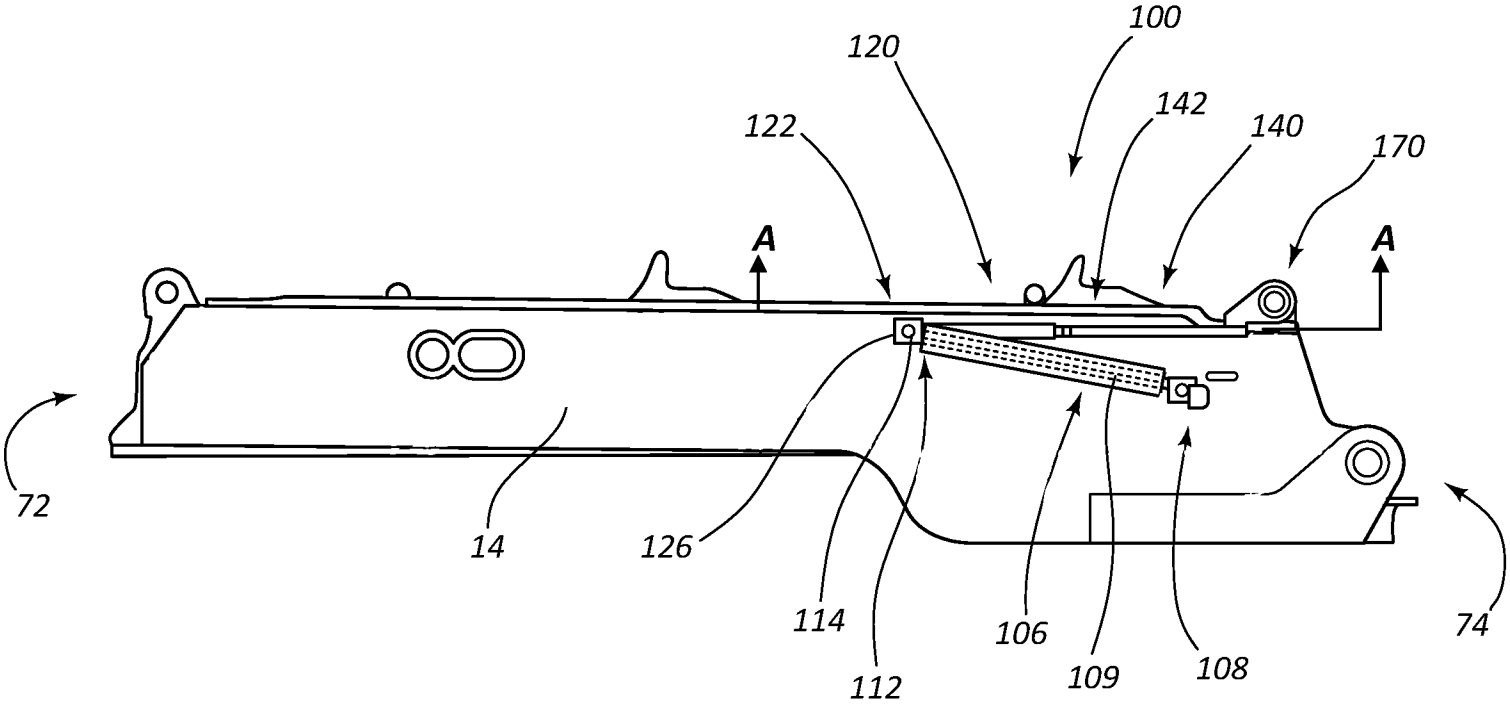
FIG. 4 is a side elevation view of the rotating bed and the biasing mechanism of the crane of FIG. 1 with the mast and several other elements removed for clarity.

In the illustrated embodiment, the hydraulic cylinder 106 is extendable to raise the mast 34. The hydraulic cylinder 106 includes a first end 108 pivotally coupled to the rotating bed 14. For example, the first end 108 typically is the cap end of the hydraulic cylinder 106 and it is pinned or otherwise coupled to a lug or similar structure (not illustrated) on the rotating bed 14, as known in the art. The rod 110 extends from the body 109 of the hydraulic cylinder to a second end 112 that is spaced apart from the first end 108. The second end 112 may include a clevis or other similar attachment for pivotably coupling the hydraulic cylinder 106 to a first end 122 of a first arm 120, as illustrated in FIGS. 3 and 4.

As illustrated, the hydraulic cylinder 106 is positioned proximate the front portion 74 of the rotating bed 14 so that it might more easily raise the mast 34 from its stowed position in which the mast 34 is pivoted downward towards the rear portion 72 of the rotating bed 14. The hydraulic cylinder 106, however, can be positioned at other locations within the rotating bed 14 as design considerations warrant.

The first arm 120, which is part of the mast-raising mechanism 100, is best illustrated in FIGS. 6-9 that provide several views of the first arm 120 in isolation. The first arm 120 includes a first end 122 that is pivotably coupled to the second end 112 of the hydraulic cylinder 106, as noted.

The first end 122 includes a plate 126 oriented to press against the bearing surface 104 on the mast 34. Optionally and as illustrated, the plate 126 is substantially vertically oriented and perpendicular to a long-axis 35 of the mast 34 when the mast 34 is in its stowed position.

When the mast-raising mechanism 100 is in its lowered or stowed position, the plate 126 is proximate the bearing surface 104 and in yet other embodiments there exists a gap between the plate 126 and the bearing surface 104. Stated differently, in one embodiment the first end 122 of the first arm 120 is not physically connected to the bearing surface 104 and/or the mast 34 when the mast-raising mechanism 100 is in its stowed position. In other embodiments, the plate 126 and the bearing surface 104 still are not physically coupled together, but the plate 126 and the bearing surface 104 do contact each other when the mast-raising mechanism 100 is in its stowed position. Alternatively, the plate 126 is coupled to the bearing surface 104 in some manner and, in some instances, may be integrally formed with the bearing surface 104.

When it is desired to raise the mast 34 from its stowed position, the hydraulic cylinder 106 extends and urges the first end 122 of the first arm 120 towards and eventually into contact with the bearing surface 104. Alternatively, it may be considered that the hydraulic cylinder 106 extends and urges the plate 126 into contact with the bearing surface 104. Of course, if the plate 126 and the bearing surface 104 are in contact already with the mast 34 in the stowed position, the hydraulic cylinder 106 and urges the first end 122 and the plate 126 against or further into contact with the bearing surface 104. Of course, it will be understood that in other embodiments the rod 110 of the hydraulic cylinder 106 extends and urges the first end 122 and/or the plate 126 into contact with the bearing surface 104. Regardless, once the plate 126 contacts the bearing surface 104 the hydraulic cylinder 106 urges the plate 126 and the bearing surface 104 away from the first end 108 of the hydraulic cylinder 106, thereby raising the mast 34 from its stowed position.

Optionally, the first end 120 includes a top plate 132, and at least one side plate 133. In this instance, two side plates 133 are illustrated. The side plates 133 optionally include a through hole 134 configured to receive a pin (not illustrated) or other fastening mechanism that couples the first end 122 of the first arm 120 to a clevis or similar structure at the second end 112 of the hydraulic cylinder. In the illustrated embodiment the plate 126, top plate 132, and side plates 133 are coupled together, typically through welds or other similar fastening methods. Alternatively, these components may be integrated into a contiguous structure through machining, for example.

Figure 6:
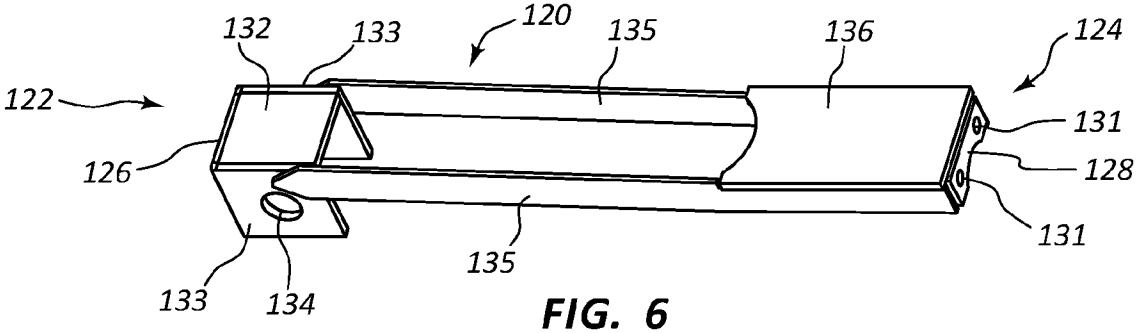
FIG. 6 is a top perspective view of a first arm of the biasing mechanism.
Figure 7:
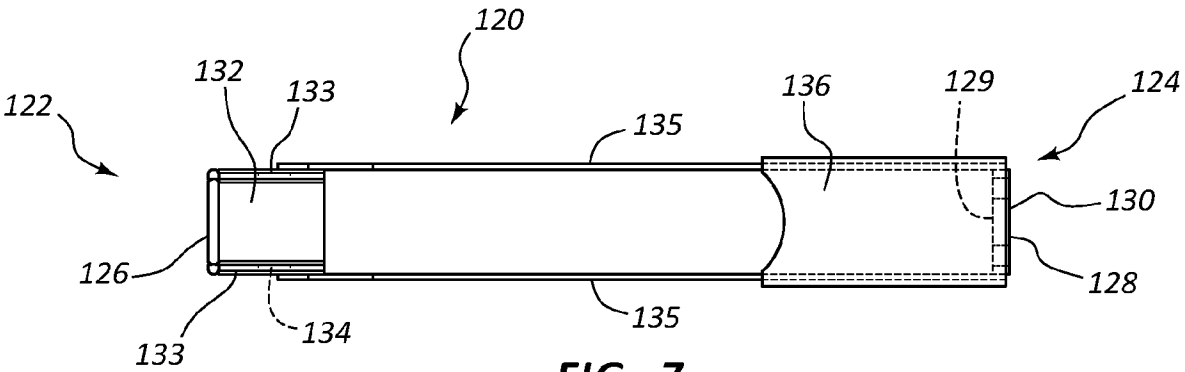
FIG. 7 is a top elevation view of the first arm of FIG. 6.
Figure 8:
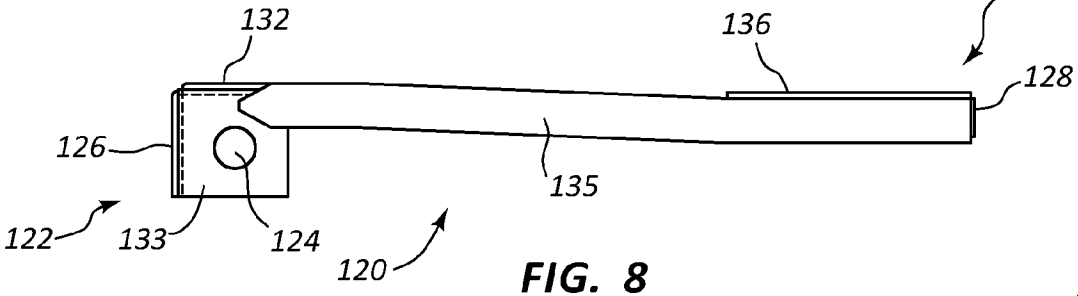
FIG. 8 is a side elevation view of the first arm of FIG. 6.
Figure 9:
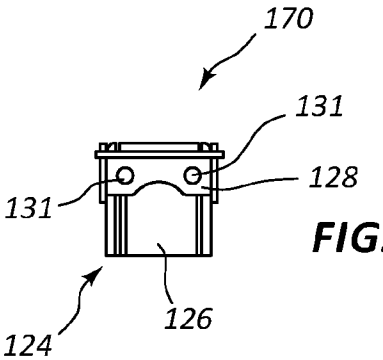
FIG. 9 is a rear elevation view of the first arm of FIG. 6.
Figure 10:
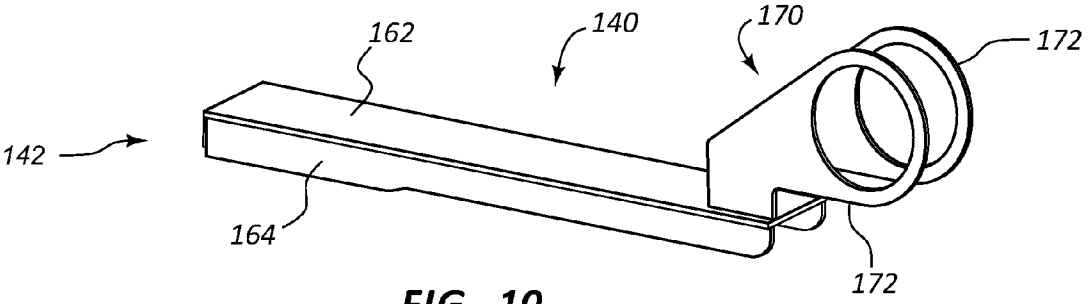
FIG. 10 is a top perspective view of a second arm of the biasing mechanism.
Figure 11:
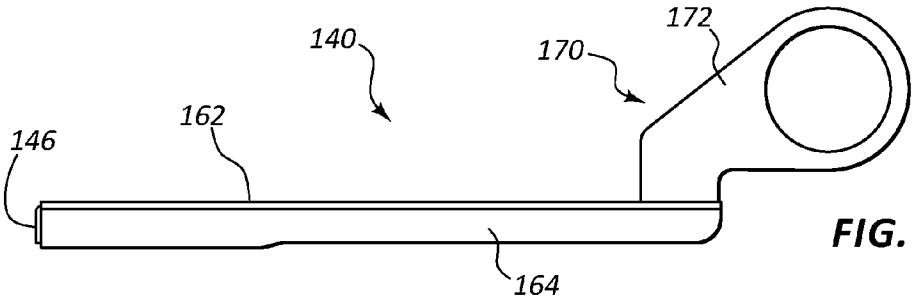
FIG. 11 is a side elevation view of the second arm of FIG. 10.

The first arm 120 includes an end plate 128 proximate the second end 124 of the first arm 120. The end plate 128 includes a first side 129, a second side 130 spaced apart from the first side 129, and at least one hole 131 extending through the first side 129 and the second side 130. FIGS. 6 and 9 illustrate two holes 131, although other embodiments might have only one hole or a plurality of holes.

The first arm 120 includes at least one, and in the illustrated embodiment, a plurality of guide arms 135 that join the first end 122 to the second end 128. The guide arms 135 illustrated are plates coupled to the first end 122 and, more specifically, the sides 133, and the second end 128 and, specifically, the end plate 128, via welds or other known methods. Alternatively, the guide arms 135 are coupled to the sides 133 through a pin joint, such as a pin-and-hole or a pin-and-slot connection, or other similar connection that provides a controlled measure of play or looseness in the connection between the guide arms 135 and the sides 133. A connection that provides a designed measure of play may have beneficial use in that it allows the first end 122 and, more specifically, the plate 126, to better conform to the orientation of the bearing surface 104 so as to provide a greater contact area over which the hydraulic cylinder 106 urges the plate 126 into the bearing surface 104. Such a connection, therefore, adapts to any slight variations that may occur during the manufacturing process. The guide arms 135 alternatively can be made from bar stock, round stock, tubes, and other shapes as one of skill in the art would appreciate.

Optionally, another top plate 136 is coupled to the end plate 131 and the guide arms 135 proximate the second end 124 via welds or other known methods. While illustrated as separate components fastened together, the components 122-136 may also be integrated into a contiguous structure through machining, for example. The top plate 136 is illustrated as extending only partly between the second end 124 and the first end 122, although it optionally extends fully between the second end 124 and the first end 122. In the latter event, the top plate 136 optionally is coupled to the top plate 132 or is formed integrally with the top plate 132 as a single combined top plate 132/136.

The mast-raising mechanism 100 includes a second arm 140 is best illustrated in FIGS. 10-13, which provide several views of the second arm 140 in isolation. The second arm 140 includes a first end 142 proximate the second end 128 the first arm 120 and a second end 170 spaced apart from the first end 142.

Figure 12:
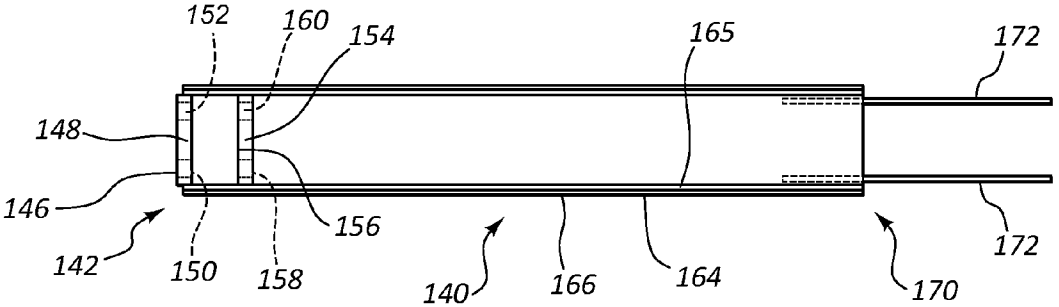
FIG. 12 is a top elevation view of the second arm of FIG. 10.
Figure 13:
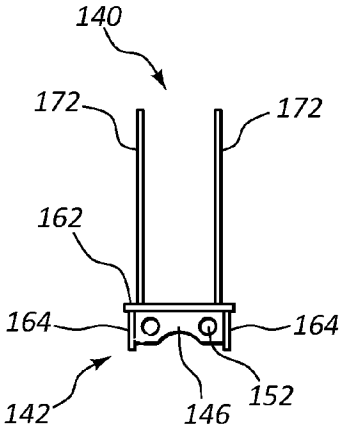
FIG. 13 is a front elevation view of the second arm of FIG. 10.

The second arm 140 includes an outer plate 146 proximate the first end 142 of the second arm 140. The outer plate 146 includes a first side 148, a second side 150 spaced apart from the first side 148, and at least one hole 152 extending through the first side 148 and the second side 150. FIGS. 12 and 13 illustrate two holes 152, although other embodiments might have only one hole or a plurality of holes.

Figure 5:
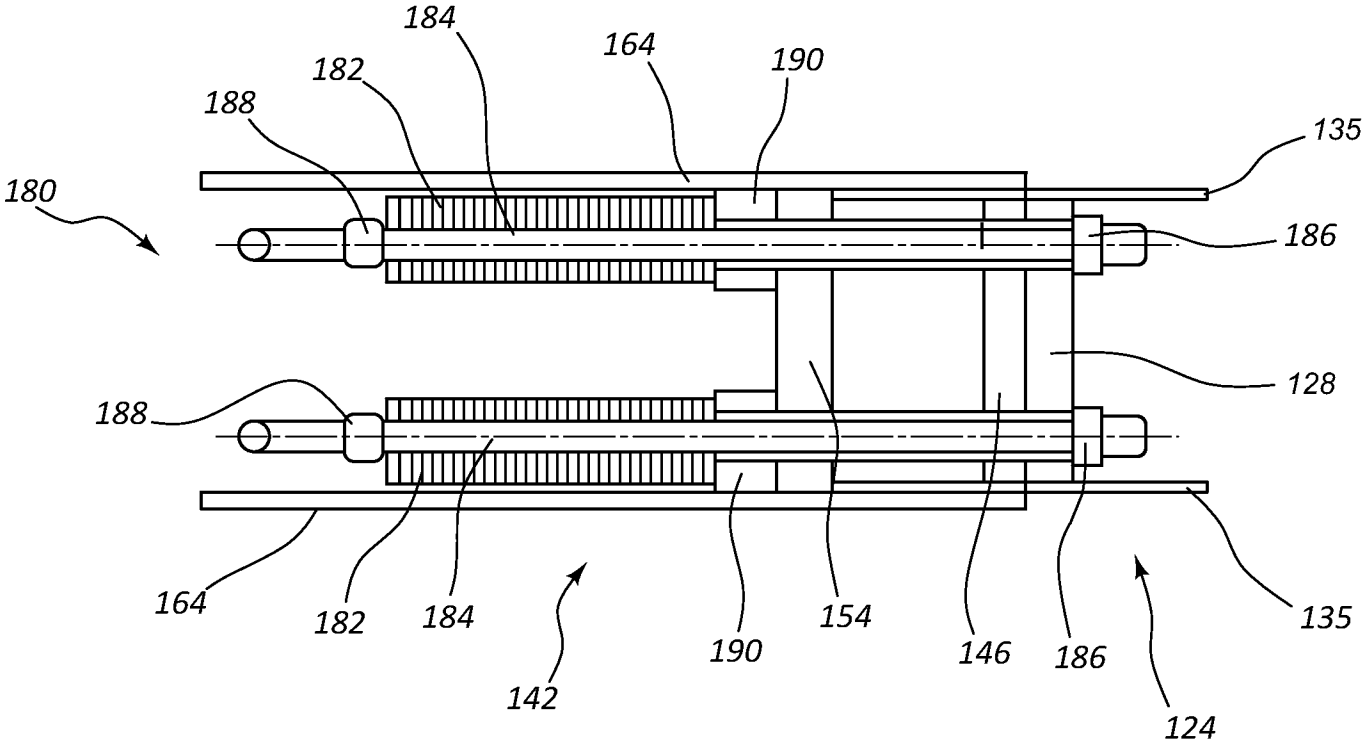
FIG. 5 is a partial cross-section A-A viewed from below of the biasing mechanism illustrated in FIG. 4.

As illustrated in FIGS. 3-5, the second end 124 of the first arm 120 abuts the first end 142 of the second arm 140 when the mast-raising mechanism 100 is stowed. More particularly, the second side 130 of the end plate 128 abuts the first side 148 of the outer plate 146 when the mast-raising mechanism 100 is in the stowed position. In other embodiments, the end plate 128 and the outer plate 146 are proximate each other, but do not abut, when the mast-raising mechanism 100 is in its stowed position.

As discussed above, when it is desired to raise the mast 34 from its stowed position, the hydraulic cylinder 106 extends and urges the first end 122 of the first arm 120 towards and eventually into contact with the bearing surface 104 if the first end 122 is not already in contact with the bearing surface 104. Regardless, as the hydraulic cylinder extends, the second end 124 of the first arm 120 will move apart from and no longer abut the first end 142 of the second arm 140 if the second end 124 was initially abutting the first end 142. Stated differently, a gap will open and/or increase (if a gap previously existed) between the second end 124, specifically the end plate 128, and the first end 142 of the second arm 140, specifically the outer plate 146.

The second arm 140 optionally includes an inner plate 154 positioned between the outer plate 146 and the second end 170 of the second arm 140. Like the outer plate 146, the inner plate 154 includes a first side 156, a second side 158, spaced apart from the first side 156, and at least one hole 160 extending through the first side 156 and the second side 156.

The second arm 140 optionally includes a top plate 162 and at least one side plate 164. In this instance, two side plates 164 are illustrated. Further, the side plates optionally comprise a plurality of plates, such as plates 165 and 166, coupled together to form the side plate 164. The side plate 164 alternatively can be made from bar stock, round stock, tubes, and other shapes as one of skill in the art would appreciate. The side plates 164 extend from the first end 142 of the second arm to the second end 170 of the first arm. Likewise, the top plate 162 optionally extends from the first end 142 where the top plate 162 is coupled to the outer plate 146, across and coupled to the inner plate 154 and the side plates 164, and at least partly to the second end 170 of the second arm 140. In other words, the top plate 162 may be solid or it may include holes or discontinuities in it. In the illustrated embodiment the outer plate 146, inner plate 154, top plate 162, and side plates 164 are coupled together, typically through welds or other similar fastening methods. Alternatively, these components may be integrated into a contiguous structure through machining, for example.

The second end 170 of the second arm is pivotably connected to the rotating bed 14. For example, the second arm optionally includes at least one lug 172, and as illustrated, a plurality of lugs 172, that couple to a corresponding lug 80 (FIG. 3) on the rotating bed 14 through the use of a pin (not illustrated) as will be appreciated. Of course, other types of pivotal connections can be used.

The mast-raising mechanism 100 includes a biasing mechanism 180 that couples the second end 124 of the first arm 120 to the first end 142 of the second arm 140. In addition, the biasing mechanism 180 urges the first arm 120 towards the second arm 140. Stated differently, the biasing mechanism applies a force to at least one of the first arm 120 and the second arm 140 that urges the first arm 120 and the second arm 140 together.

As noted above, the second end 124 of the first arm 120 typically, although not necessarily, abuts the first end 142 of the second arm 140 when the mast-raising mechanism 100 is stowed. This result is at least in part a function of the biasing mechanism 180 urging the first arm 120 and the second arm 140 together. In other words, the biasing mechanism 180 is configured to apply a pre-load to the mast-raising mechanism 100.

Likewise, and as noted, when the mast-raising mechanism 100 is in its lowered or stowed position, the plate 126 is typically in contact with the bearing surface 104, or at least proximate the bearing surface 104, and in yet other embodiments there exists a gap between the plate 126 and the bearing surface 104. This, too, is at least in part a function of the biasing mechanism 180 urging the first arm 120 and the second arm 140 together or, stated differently, urging the first arm 120 away from the bearing surface 104. Optionally, the pre-load of the biasing mechanism 180 is adjusted to ensure that plate 126 remains in contact with and/or proximate to the bearing surface 104.

Further, the force that the biasing mechanism 180 includes a directional component that acts in a direction opposite to a directional component of the force that the hydraulic cylinder 106 generates. As noted above, when it is desired to raise the mast 34 from its stowed position, the hydraulic cylinder 106 extends and urges the first end 122 of the first arm 120 towards the bearing surface 104 and, if the first end 122 is not at least initially in contact with the bearing surface 104, eventually into contact with the bearing surface 104. Thus, the force that the hydraulic cylinder 106 applies to urge the first arm 120 towards the bearing surface 104 must first overcome any pre-load that the biasing mechanism 180 applies to the first arm 120.

Embodiments of the biasing mechanism 180 include various types of springs, hydraulic cylinders and other biasing mechanisms. In some embodiments, the biasing mechanism 180 includes or displays a substantially linear force-displacement relationship, i.e., one that generally follows Hooke's law. As illustrated, an embodiment of the biasing mechanism 180 includes at least one spring 182. A plurality of springs 182 are illustrated in FIG. 5.

In addition, the biasing mechanism 180 includes at least one rod 184 that extends through at least one of the holes 131, 152, and 160 through the end plate 128, outer plate 146, and inner plate 154, respectively. Illustrated in FIG. 5 are a plurality of rods 184. The rod 184 is coupled to at least the end plate 128, and to at least one of the outer plate 146 and the inner plate 154. As illustrated, the rod 184 is threaded rod, and a threaded nut 186 couples the rod 184 to the end plate 128. Similarly, a threaded nut 188 couples the rod 184 to the inner plate 154. Of course, other mechanisms to couple the rod 184 to the end plate 128 and the inner plate 154 can be used.

The spring 182 is illustrated disposed around at least a part of the rod 184. In this embodiment, the spring 182 is positioned between the threaded nut 188 and a spacer 190, which itself is positioned between the spring 182 and the second side 158 of the inner plate 154. The threaded nut 188 in this embodiment at least partly compresses the spring 182 against the second side 158 of the inner plate 154, which provides the pre-load discussed above. Of course, the spring 184 may be positioned differently around the rod 184 relative to the end plate 128, outer plate 146, and inner plate 154.

In addition to the embodiments of a crane 10 and mast-raising mechanism 100 discussed above, methods of raising a mast on a crane are also disclosed. On a crane 10 that includes a mast 34 and a mast-raising mechanism 100, the method includes extending the hydraulic cylinder 106 to open a gap between the second end 124 of the first arm 120 and the first end 142 of the second arm 140; urging the first end 122 of the first arm 120 against the bearing surface 104 to raise the mast 34 to a stable upright position; retracting the hydraulic cylinder 106 at least partly under the influence of the biasing mechanism 180 urging the first arm 120 towards the second arm 140; and, closing the gap between the second end 128 of the first arm 120 and the first end 142 of the second arm 140. Further, the method includes at least partly stowing the hydraulic cylinder 106, the first arm 120, and the second arm 140 in the rotating bed 14.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

What is claimed is:

1. A mast-raising mechanism for raising a mast of a mobile lift crane, said crane including movable ground engaging members mounted on a carbody allowing said crane to move over the ground, a rotating bed rotatably mounted on said carbody, said mast being pivotally connected to said rotating bed, said mast having a lower surface oriented towards said rotating bed when said mast is stowed in a substantially horizontal position for travel, said mast-raising mechanism comprising:

a) a bearing surface coupled to said lower surface of said mast;

b) a linear actuator extendable to raise said mast, said linear actuator including a first end pivotally coupled to said rotating bed and a second end spaced apart from said first end of said linear actuator;

c) a first arm including a first end pivotably coupled to said second end of said linear actuator, said first end of said first arm including a plate oriented to press against said bearing surface to raise said mast when said linear actuator is extended, and a second end spaced apart from said first end of said first arm;

d) a second arm including a first end proximate said second end of said first arm, and a second end spaced apart from said first end of said second arm, said second end of said second arm being pivotably connected to said rotating bed; and, e) a biasing mechanism coupling said second end of said first arm to said first end of said second arm, said biasing mechanism urging said first arm towards said second arm.

2. The mast-raising mechanism of claim 1, wherein said bearing surface is configured to contact said plate of said first arm when said mast is stowed.

3. The mast-raising mechanism of claim 1, wherein each of said bearing surface and said plate of said first arm are substantially vertically oriented and perpendicular to a long-axis of said mast when said mast is stowed in the substantially horizontal position.

4. The mast-raising mechanism of claim 1, wherein said biasing mechanism displays a substantially linear force-displacement relationship.

5. The mast-raising mechanism of claim 1, wherein said biasing mechanism includes a spring.

6. The mast-raising mechanism of claim 1, wherein a) said first arm includes an end plate proximate said second end of said first arm, said end plate having a first side, a second side spaced apart from said first side, and at least one hole extending through said first side and said second side;

b) said second arm includes an outer plate proximate said first end of said second arm, said outer plate having a first side, a second side spaced apart from said first side, and at least one hole extending through said first side and said second side, and, c) wherein said biasing mechanism includes a rod extending through each of said holes of said end plate and said outer plate, said rod being coupled to at least said end plate.

7. The mast-raising mechanism of claim 6, wherein said second arm includes an inner plate positioned between said outer plate and said second end of said second arm, said inner plate having a first side, a second side spaced apart from said first side, and at least one hole extending through said first side and said second side, and wherein said rod extends through said hole of said inner plate and is coupled to said inner plate.

8. The mast-raising mechanism of claim 6, wherein said biasing mechanism includes a spring disposed around at least a part of said rod.

9. The mast-raising mechanism of claim 6, wherein said rod comprises a threaded rod, said biasing mechanism further comprising a nut configured to hold said threaded rod against said first side of said end plate and another nut configured to at least partly compress said biasing mechanism against said second side of said inner plate.

10. The mast-raising mechanism of claim 1, wherein said linear actuator is a hydraulic cylinder.

11. The mast-raising mechanism of claim 1, wherein said mast is a live mast.

12. A mobile lift crane, said crane comprising:

a) movable ground engaging members mounted on a carbody allowing said crane to move over the ground;

b) a rotating bed rotatably mounted on said carbody;

c) a mast pivotally connected to said rotating bed, said mast being stowed in a substantially horizontal position for travel and being raised to an operating position during operation, said mast having a lower surface oriented towards said rotating bed when said mast is stowed, said lower surface including a bearing surface coupled thereto; and, d) hydraulic cylinder extendable to raise said mast from a stowed position to an operating position, said hydraulic cylinder including a first end pivotally coupled to said rotating bed and a second end spaced apart from said first end;

e) a first arm including a first end pivotably coupled to said second end of said hydraulic cylinder and a second end spaced apart from said first end;

f) a second arm including a first end proximate said second end of said first arm, and a second end spaced apart from said first end, said second end of said second arm being pivotably connected to said rotating bed; and, g) a biasing mechanism coupling said second end of said first arm to said first end of said second arm, said biasing mechanism urging said first arm towards said second arm; and, h) wherein said second end of said first arm is configured to abut said first end of said second arm when said mast is stowed and wherein said second end of said first arm is configured to not abut said first end of said second arm when said hydraulic cylinder is in an extended position in which said first end of said first arm presses against said bearing surface.

13. The mobile lift crane of claim 12, wherein said first end of said first arm includes a plate oriented to press against said bearing surface when said hydraulic cylinder is in an extend position in which said first end of said first arm presses against said bearing surface.

14. The mobile lift crane of claim 12, wherein said biasing mechanism displays a substantially linear force-displacement relationship.

15. The mobile lift crane of claim 12, wherein said biasing mechanism includes a spring.

16. The mobile lift crane of claim 12, wherein a) said first arm includes an end plate proximate said second end of said first arm, said end plate having a first side, a second side spaced apart from said first side, and at least one hole extending through said first side and said second side;

b) said second arm includes an outer plate proximate said first end of said second arm, said outer plate having a first side, a second side spaced apart from said first side, and at least one hole extending through said first side and said second side, and, c) wherein said biasing mechanism includes a rod extending through each of said holes of said end plate and said outer plate, said rod being coupled to at least said end plate.

17. The mobile lift crane of claim 16, wherein said second arm includes an inner plate positioned between said outer plate and said second end of said second arm, said inner plate having a first side, a second side spaced apart from said first side, and at least one hole extending through said first side and said second side, and wherein said rod extends through said hole of said inner plate and is coupled to said inner plate.

18. The mobile lift crane of claim 16, wherein said biasing mechanism includes a spring disposed around at least a part of said rod.

19. The mobile lift crane of claim 16, wherein said rod comprises a threaded rod, said biasing mechanism further comprising a nut configured to hold said threaded rod against said first side of said end plate and another nut configured to at least partly compress said biasing mechanism against said second side of said inner plate.

20. A method of raising a mast on a mobile lift crane from a stowed position to an operating position, the crane including movable ground engaging members mounted on a carbody allowing said crane to move over the ground, a rotating bed rotatably mounted on said carbody, said mast being pivotally connected to said rotating bed, said mast having a lower surface oriented towards said rotating bed when said mast is stowed in a substantially horizontal position for travel, a bearing surface coupled to said lower surface of said mast, a hydraulic cylinder extendable to raise said mast, said hydraulic cylinder including a first end pivotally coupled to said rotating bed and a second end spaced apart from said first end, a first arm including a first end pivotably coupled to said second end of said hydraulic cylinder, said first end including a plate oriented to press against said bearing surface to raise said mast when said hydraulic cylinder is extended, and a second end spaced apart from said first end, a second arm including a first end proximate said second end of said first arm, and a second end spaced apart from said first end, said second end of said second arm being pivotably connected to said rotating bed, and a biasing mechanism coupling said second end of said first arm to said first end of said second arm, said biasing mechanism urging said first arm towards said second arm, said method comprising:

a) extending said hydraulic cylinder to open a gap between said second end of said first arm and said first end of said second arm;

b) urging said first end of said first arm against said bearing surface to raise said mast to a stable upright position;

c) retracting said hydraulic cylinder at least partly under the influence of the biasing mechanism urging said first arm towards said second arm; and, d) closing said gap between said second end of said first arm and said first end of said second arm.

21. The method of claim 20, further comprising at least partly stowing said hydraulic cylinder, said first arm, and said second arm at least partly within said rotating bed.

* * * * *